US007055288B2

(12) United States Patent
Coogan

(10) Patent No.: US 7,055,288 B2
(45) Date of Patent: Jun. 6, 2006

(54) PRE-STRESSING SHEATH

(76) Inventor: Donald B. Coogan, 7107 Farrington Farms Dr., Wilmington, NC (US) 28411

( * ) Notice: Subject to any disclaimer, the term of this patent is extended or adjusted under 35 U.S.C. 154(b) by 0 days.

(21) Appl. No.: 10/414,764

(22) Filed: Apr. 16, 2003

(65) Prior Publication Data

US 2004/0206026 A1 Oct. 21, 2004

(51) Int. Cl.
*E04B 1/00* (2006.01)
*E04C 5/08* (2006.01)

(52) U.S. Cl. ..... 52/222; 52/223.14; 52/748.11

(58) Field of Classification Search ..... 52/222, 52/223.1, 223.2, 223.9, 223.11, 223.14, 749.06, 52/748.11; 248/49, 62, 68.1, 74.1–74.3, 248/229.26; 362/396, 250, 388, 249
See application file for complete search history.

(56) References Cited

U.S. PATENT DOCUMENTS 2,219,161 A * 10/1940 Jacobs ..... 285/365
2,365,550 A 12/1944 Heltzel
2,834,266 A 5/1958 Brickman
3,245,189 A 4/1966 Reiland
3,245,190 A 4/1966 Reiland
3,848,839 A * 11/1974 Tillman ..... 248/74.2
3,853,130 A * 12/1974 Sheridan ..... 604/171
4,114,344 A * 9/1978 Heasman ..... 52/742.15
4,627,212 A 12/1986 Yee
4,633,540 A 1/1987 Jungwirth et al.
4,834,576 A 5/1989 Argento
4,878,327 A 11/1989 Nutzel et al.
4,959,909 A * 10/1990 Wong ..... 33/561.1
5,677,513 A * 10/1997 Ito et al. ..... 174/72 A
5,863,108 A * 1/1999 Lederer ..... 362/186
5,981,876 A 11/1999 Fukui
6,052,957 A * 4/2000 Minnich ..... 52/202
6,109,765 A * 8/2000 Blanton ..... 362/250
6,389,774 B1 5/2002 Carpenter
6,458,104 B1 * 10/2002 Gautsche ..... 604/179

FOREIGN PATENT DOCUMENTS

DE 19856605 * 6/2000
FR 2697232 * 4/1994

* cited by examiner

*Primary Examiner*—Anita King
*Assistant Examiner*—Tan Le
(74) *Attorney, Agent, or Firm*—MacCord Mason PLLC

(57) ABSTRACT

A pre-stressing sheath for preventing wet concrete from penetrating between the sheath and strands being debonded, and for covering sections of reinforcing strands in pre-stressed concrete beams such that any potential strand tension transmitted to a beam is nullified by allowing the strands to slide freely within the pre-stressing sheath. The pre-stressing sheath is made up of a first hollow cylindrical sheath section having a longitudinal slit that allows the first sheath section to be opened and placed about the concrete reinforcing element, and a second hollow cylindrical sheath section having a longitudinal slit that allows the sheath section to be opened and placed about both the concrete reinforcing element and the first sheath section. The first sheath section further includes an integral outwardly projecting ridge for interlocking with the longitudinal slit of the second hollow cylindrical sheath section.

7 Claims, 1 Drawing Sheet

PRE-STRESSING SHEATH

BACKGROUND OF THE INVENTION (1) Field of the Invention

The present invention relates generally to a pre-stressing sheath for preventing wet concrete from penetrating between the sheath and strands being debonded. In particular, the present invention relates to plastic clip-on type sleeves used to encircle and debond concrete reinforcing members such as cables.

(2) Description of the Prior Art

Pre-cast concrete construction elements such as bridge girders, etc., are stressed by placing tension on an elongated cylindrical rod or cable bundle having a generally circular cross-sectional area normally formed of twisted wires generally referred to as strands. Strands that are placed in a straight configuration near the bottom of a pre-stressed girder tend to overstress near the end of the girder at the moment of de-tensioning. In order to avoid this overstress, several strands are usually draped upwardly near each girder end to reduce the eccentricity of the force they cause about the centroid of the girder. The effort required to position and stress the draped strands is expensive, time consuming, difficult and dangerous.

Recently, a less expensive, faster, easier and safer technique for eliminating overstress has been developed and used commercially to prevent the undesirable overstress. The improved procedure, places and stresses the strands necessary for flexure at mid-span of a girder in a straight configuration extending over the entire length of the girder. The overstress near the ends of the girder at the moment of de-tensioning is avoided by debonding several strands from the end of the girder towards mid-span over a length which would otherwise be overstressed. This eliminates the eccentric forces that the debonded strands would otherwise generate about the centroid of the girder, and thus reduces stresses.

Generally, the debonding of one or more strands is accomplished by placing a debonding sheath about the strands to be debonded. Once the sheath is installed on the strands, the ends of the sheath are sealed to help prevent the strands from coming into contact with a mortar that is used to bond unprotected strands to the girder's concrete mass. At present, the preferred debonding sheath is a plastic tube having a longitudinal slit that allows the tube to be clipped over the strands to be debonded. However, because of the longitudinal slit, this type of sheath is not as protective in preventing wet mortar from coming into contact with the strands to be debonded. Therefore, while the split debonding sheath is currently favored, it by itself does not offer an adequate strand debonding solution.

Another attempt to prevent mortar from coming into contact with strands uses a hollow cylinder having a continuous wall that slides over the strands to be debonded. While a hollow cylinder having a continuous wall offers the best protection for preventing wet mortar from coming into contact with the strands, it is difficult and sometimes impossible to apply. What is needed is a pre-stressing sheath that offers the debonding protection of a hollow cylinder having a continuous wall along with the ease of use of a split debonding sheath.

SUMMARY OF THE INVENTION

Generally, the pre-stressing sheath of the present invention is comprised of a pair of hollow cylindrical sheath sections used in combination to protect and debond strands. Each hollow cylindrical sheath section has a central longitudinal axis and a longitudinal slit parallel to its longitudinal axis extending along its length so that it can be opened along the slit and readily placed around more than half the circumference of a cable bundle or strands to be debonded.

Each sheath section is a single sheet of material, in which case the sheath section must be sufficiently flexible to permit it to be opened along the longitudinal slit and placed around a cable bundle or strands to be debonded. The circumference of each sheath section is greater than 180 degrees. Moreover, each sheath section is made of a relatively rigid and resilient material, preferably from a relatively rigid plastic such as a high-density polyethylene, polypropylene, polyvinyl chloride or the like. Moreover, it is preferred that the inside diameter of each sheath section be substantially equal to the given effective diameter of a generally cylindrical bundle of cables or strands to be debonded whenever the sheath section is in an unflexed state.

In use, a first sheath section is opened along its longitudinal slit just enough to be placed over a strand to be debonded. A second sheath section is opened along its longitudinal slit and is placed over both the strand and the first sheath section. The first and second sheath sections should be rotated about the enclosed strand relative to each other such that the longitudinal slit of the first sheath section does not coincide with the longitudinal slit of the second sheath section. Preferably, the longitudinal slits are positioned opposite to each other to maximize the seal protecting the strands from wet mortar.

In a preferred embodiment of the invention, the sheath sections can be interlocked in order to prevent the inadvertent and coincidental alignment of the respective longitudinal slits during mortar pouring operations. An interlocking structure consists of an outwardly projecting ridge integral with the outer surface of the longitudinally slit hollow cylinder serving as the first sheath section and is sized to fit within the slit of the second sheath section whenever the second sheath section is clipped about the first. Preferably, this outwardly projecting ridge extends the length of the first sheath section and is opposite the longitudinal slit of the first sheath section. An added benefit is that the outwardly projecting ridge also functions as a reinforcing spine.

In a preferred embodiment, the first and second sheath sections are identical with one advantage being minimized manufacturing costs. Another advantage is that identical first and second sheath sections allow interchangeability. Therefore only one type of sheath section needs to be in inventory to complete any given sheathing task.

The present invention also includes a method for preventing wet mortar from bonding to strands used to provide tension in pre-stressed concrete construction. The method is comprised of steps of providing a first longitudinally slit hollow cylindrical sheath section made of a flexible and resilient material, further including an outwardly projecting ridge, then opening the first sheath section along the first sheath sections longitudinal slit and placing it about the strands. A second longitudinally slit hollow cylindrical sheath section of a flexible and resilient material is then provided and is opened along its longitudinal slit and placed about the first sheath section. An additional step can be rotating the second sheath section relative to the first sheath section, such that the first sheath section's outwardly projecting ridge engages the longitudinal slit of the second sheath section. In this configuration, the sheath of the present invention will prevent wet mortar from contacting the protected strand through either longitudinal slit of either sheath section. Mortar can be prevented from entering the ends of the sheath by traditional methods such as taping or plugging up the ends.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
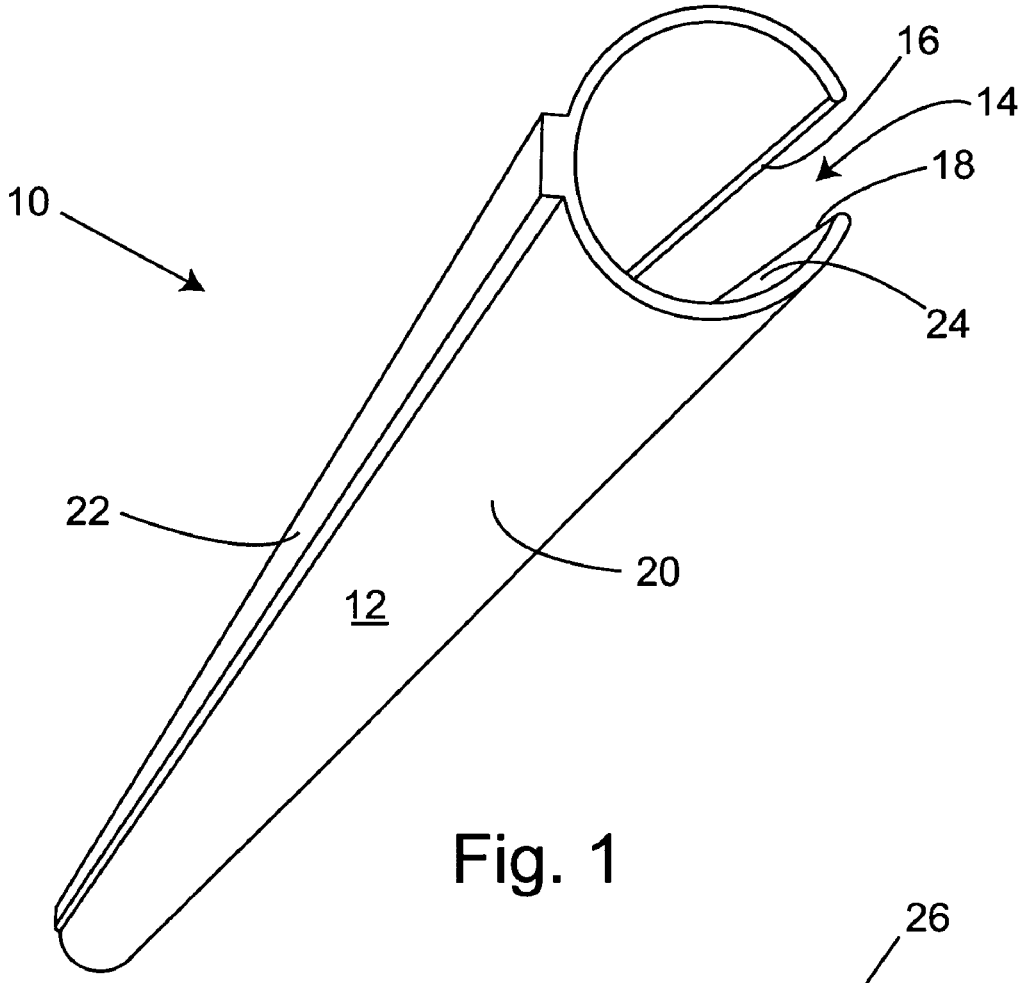
FIG. 1 is a perspective view of the pre-stressing sheath section of the present invention.

Referring to the drawings and first to FIG. 1, a sheath section 10 comprises a first hollow cylinder 12 having a longitudinal slit 14 bounded by longitudinal edges 16 and 18. Sheath section 10 has an outer surface 20 that includes an outwardly projecting ridge 22 for aligning with the longitudinal slit of a second sheath section. Outwardly projecting ridge 22, also serves as a reinforcing spine extending the length of sheath section 10. Preferably, ridge 20 is located directly opposite longitudinal slit 14. Sheath section 10 has an inside surface 24 that has an inside diameter or circumference sized to envelop over half the circumference of a concrete reinforcing member to be debonded.

Figure 2:
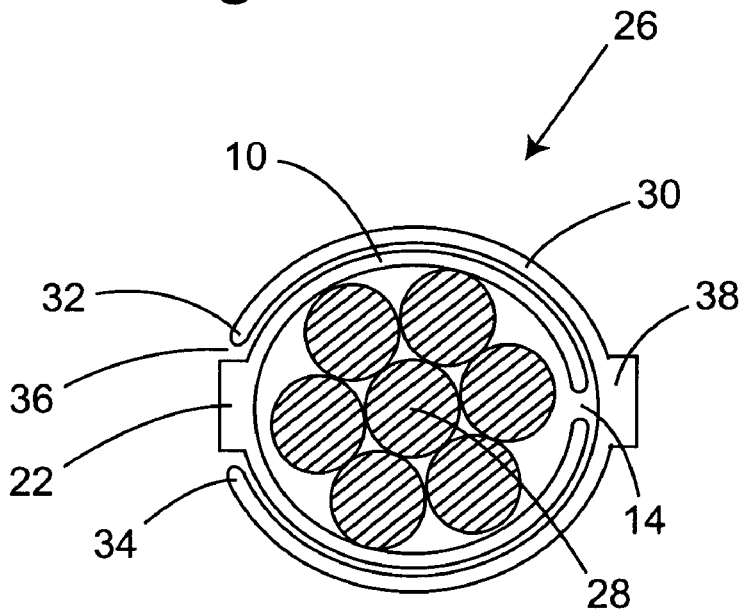
FIG. 2 is a cross-sectional view of the pre-stressing sheath showing a first hollow cylindrical sheath section interlocked with a second hollow cylindrical sheath section.

FIG. 2 shows an end view of a pair of sheath sections combined to complete a sheath 26 according to the present invention. Sheath 26, is made up of first sheath section 10 shown encircling a plurality of strands 28. A second sheath section 30 is clipped over first sheath section 10 such that it seals longitudinal slit 14. Second sheath section 30 has longitudinal edges 32 and 34 that capture ridge 22 of first sheath section 10 whenever ridge 22 engages slit 36 of sheath section 30. A reinforcing spine 38 is also included for sheath section 30. However, this spine can be eliminated if sheath section 30 is deemed strong enough not to need reinforcement.

Sheath 26 is used by opening sheath section 10 by urging longitudinal edges 16 and 18 away from each other until longitudinal slit 14 is open enough to span the effective circumference of strands 28. Next, sheath section 10 is placed about strands 28 and longitudinal edges 16 and 18 are released. Once released, edges 16 and 18 snap back towards each other due to the resiliency of the material from which sheath section 10 is made. Next, sheath section 30 is opened by urging longitudinal edges 32 and 34 away from each other until longitudinal slit 36 is open enough to span the effective circumference of strands 28 and outer surface 20. Then sheath section 30 is placed about both sheath section 10 and strands 28. Once released, edges 32 and 34 snap back towards each other due to the resiliency of the material from which sheath section 30 is made. Next, sheath section 30 is rotated axially relative to sheath section 10 until ridge 22 of sheath section 10 engages longitudinal slit 36 of sheath section 30. If necessary, sheath section 30 can be slid longitudinally to a position that maximizes the sealing of longitudinal slit 14. At this point with the exception of plugging the ends of sheath sections 10 and 30, sheath 26 is properly configured to seal strands 28 from mortar intrusion.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A pre-stressing sheath for covering a section of reinforcing strand in a pre-stressed concrete beam such that any potential strand tension transmitted to the beam is nullified by allowing the strand to slide freely within the pre-stressing sheath, said sheath comprising:

a) a first hollow cylindrical sheath section having a first longitudinal slit that allows said first sheath section to be opened and placed over the strand, said first hollow cylindrical sheath including a first outwardly projecting ridge opposite said first slit; and b) a second hollow cylindrical sheath section having a second longitudinal slit that allows said second sheath section to be opened and placed over said first sheath section, said second hollow cylindrical sheath section including a second outwardly projecting ridge opposite said second slit, said second sheath section being over said first sheath section with said first ridge projecting through said second slit and said second ridge being opposite said first ridge, said first and second sheath sections being identical and interchangeable.

2. The sheath of claim 1, wherein said first ridge has a given width and said second slit has a width approximately equal to said given width when said second sheath section is placed over said first sheath section.

3. The pre-stressing sheath of claim 1, wherein said ridges have a given height and said sheath sections have a continuous wall thickness approximately equal to said given height.

4. The pre-stressing sheath of claim 1, wherein said ridges extend the lengths of said sheath sections.

5. The pre-stressing sheath of claim 1, wherein said first and second sheath sections are made of a resilient plastic material.

6. The pre-stressing sheath of claim 5, wherein said plastic material is selected from the group of plastic materials consisting of high-density polyethylene, polypropylene, and polyvinyl chloride.

7. The pre-stressing sheath of claim 1, wherein said strand has a given circumference and said first sheath section is sized to encompass over half the given circumference of said strand.

* * * * *